US006063144A

United States Patent [19]

Calzada et al.

[11] Patent Number: 6,063,144

[45] Date of Patent: May 16, 2000

[54] NON-PARAFFIN CANDLE COMPOSITION

[76] Inventors: Jose Francisco Calzada, Carretera Roosevelt, Km. 14, 5-70 Zona 2 de Mixco, Guatemala; Janardan Upadhyaya, 43 Catherine St., Fairfield, Conn. 06430

[21] Appl. No.: 09/255,951

[22] Filed: Feb. 23, 1999

[51] Int. Cl.[7] ..... C10L 5/00; F23D 3/16

[52] U.S. Cl. ..... 44/275; 431/126; 431/288

[58] Field of Search ..... 44/275; 431/126, 431/288

[56] References Cited

U.S. PATENT DOCUMENTS 3,613,658 10/1971 Knowles et al. ..... 44/275
3,630,697 12/1971 Daling et al. ..... 44/275
3,843,312 10/1974 Easterday ..... 44/275
3,871,815 3/1975 Cangardel ..... 44/275
5,879,694 3/1999 Morrison et al. ..... 44/269
5,919,423 7/1999 Requejo et al. ..... 44/275

*Primary Examiner*—Jacqueline V. Howard
*Attorney, Agent, or Firm*—Robert M. Schwartz; Otto Kauder

[57] ABSTRACT

A substantially non-paraffin combustible candle composition consists essentially of at least 30 parts by weight of stearic acid, at least 5 parts by weight of vegetable-derived wax having a melting point of at least 50° C., 0–50 parts by weight of at least one vegetable oil, 0 to 10 parts by weight of at least one fragrance and 0 to 1 part by weight of at least one oxidation inhibitor.

29 Claims, No Drawings

NON-PARAFFIN CANDLE COMPOSITION

BACKGROUND OF THE INVENTION

1. Field of the Invention

This invention relates to a candle having a favorable combination of properties including a pleasing odor as supplied, a pleasing odor while burning and upon being extinguished, and substantial absence of smoke and unpleasant odor while burning and upon being extinguished.

2. Prior Art

The art of candlemaking has been practiced for centuries. The traditional technique still in use includes embedding a wick in a mass of combustible material and generating illumination by lighting the wick, causing the burning wick to contact and melt the exposed surface of the combustible material which then is absorbed by the wick and so sustains the flame until the combustible material is consumed or the burning candle is deliberately extinguished.

With the introduction of electric lighting the utilitarian illumination of the home and the workplace with candles declined, while the use of candles to provide a variety of esthetically satisfying effects of religious inspiration, festivity, or relaxation and intimacy has become the principal use of candles. For such esthetically driven use a pleasing odor is an important consideration, and many varieties of scented candles have been provided. While such scented candles may have an agreeable odor encouraging their purchase, the inherent odor of the combustible materials used in candles according to the art is noticeable as the combustible material burns and particularly for some time after the flame is extinguished.

With the growth of the petroleum industry, refined paraffin wax has displaced the previous use of beeswax and tallow as the dominant combustible materials in candles. Even highly refined paraffin, however, is not free of odor and smoke when burning. A need therefore remains for improved combustible material for candles with better odor properties independent of the use of added fragrance. At the same time there exists among many consumers concern about the inexorably increasing use of petroleum and other non-renewable resources and a desire for consumer products based on renewable resources and especially for products based on vegetable derived raw materials and ingredients.

U.S. Pat. No. 1,958,462 to N. Baumer disclosed a candle material consisting of pure beeswax and a vegetable oil in liquid or in solid hydrogenated form. U.S. Pat. No. 3,645,705 to A. Miller, et al., disclosed a transparent candle body gel material whose essential ingredients are light clear mineral oil and/or a natural oil as gel base, a polyamide resin as the gelling agent, and an 8-, 10, or 12-carbon primary alcohol. Without the alcohol, the oil-polyamide gel system burns with an unsatisfactorily small flame and looks and feels greasy. Preferred additional ingredients include a small percentage of a methyl ester, up to 5% of a fatty acid, and a reducing agent.

U.S. Pat. No. 5,171,329 to K. Lin disclosed manufacture of a candle from a mixture of butter oil and a solidified oil. The butter oil includes the components coconut oil, palm oil, palm olein and hydrogenate of palm oil with the as palmitic 0.1% at most and the melting point within 35–37° C. The solidified oil to which the butter oil is added meets the specification of acid value below 5.0, iodine value below 2.0, saponification value 195–198 and melting point 60° plus or minus 1° C. When the composition is burned a butter odor is released.

U.S. Pat. No. 5,578,089 to M. Elsamaloty disclosed a candle comprising a wick, a container, and a clear body gel comprising about 80 to 99% of a hydrocarbon oil, and about 1 to 20 wt % of a blend of at least one diblock copolymer and at least one triblock copolymer comprising segments of styrene monomer units and rubber monomer units.

SUMMARY OF THE INVENTION

In accordance with this invention, a substantially non-paraffin candle comprises a wick and a substantially non-paraffin combustible composition consisting essentially of at least 30 parts by weight of stearic acid, at least 5 parts by weight of vegetable-derived wax having a melting point of at least 50° C., 0–50 parts by weight of at least one vegetable oil, 0 to 10 parts by weight of at least one fragrance and 0 to 1 part by weight of at least one oxidation inhibitor.

The term "substantially non-paraffin" is used to include, in addition to the substantial absence of paraffin, such properties of a candle deemed desirable by people concerned with the protection and enjoyment of the environment as a pleasing odor as supplied, a pleasing odor while burning and upon being extinguished, substantial absence of smoke and unpleasant odor while burning and upon being extinguished, taken together with a composition constituted of at least 95% by weight of vegetable or otherwise renewable resources of natural origin and not more than 5% by weight of paraffin or otherwise non-renewable resource derived materials.

The term "consisting essentially of" is used in its art-recognized sense to express that the composition is open to the inclusion of only such additional ingredients as do not adversely affect its essential properties as defined.

DESCRIPTION OF PREFERRED EMBODIMENTS

The term "stearic acid" applied to a major ingredient of the combustible composition of this invention defines any of the commercial grades of stearic acid. While academic authorities and textbooks treat "stearic acid" as a synonym for the pure chemical compound octadecanoic acid C17H35COOH, commercial practice uses the same term for mixtures comprising major amounts of both octadecanoic acid and the 16 carbon atom hexadecanoic acid or palmitic acid C15H31COOH, together with minor amounts of lower and higher homologs, the corresponding monounsaturated acids 9-octadecenoic acid (oleic acid, C17H33COOH) and 9-hexadecenoic acid (palmitoleic acid, C15H29COOH) and a variety of trace impurities characteristic of the source of the raw material and the method used in its refining.

Specifications for stearic acids suitable according to this invention include acid number of 190–220 mg KOH/gram and maximum iodine number 7. Suitable grades of stearic acid products include so-called single pressed stearic acid, double pressed stearic acid, and triple pressed stearic acid, all of which contain octadecanoic and hexadecanoic acids in approximately 9:11 ratio along with 9-octadecenoic acid in diminishing amounts with increased pressing; so-called hydrogenated tallow fatty acids in which the ratio of octadecanoic acid and hexadecanoic acids is approximately 7:3, commercially available under trade names including Industrene 7018 (Witco Corp, Memphis, Tenn.) and Groco 57 (A. Gross & Co, Newark N.J.); and so-called "true" stearic acid products in which the ratio of octadecanoic acid and hexadecanoic is approximately 9:1, commercially available under trade names including Neo-Fat 18 (Akzona Corp) and Industrene 9018.

While the chemical reactivity including the ability to burn in a candle is substantially identical in all commercial grades of stearic acid, so that all such grades are suitable according to this invention, differences exist in physical propertied such as melting point, melt viscosity, and particularly in odor propertied. For these reasons, grades of stearic acid obtained from vegetable source raw materials are especially preferred.

Vegetable derived wax included in the composition of this invention is solid at room temperature and melts at 50° C. or higher, preferably within the range from 50 to 80° C., and preferably has an iodine number not greater than 7. Preferred vegetable derived waxes according to this invention are arrayan wax, carnauba wax, sugar cane wax, and especially candelilla wax and hydrogenated castor oil which are particularly preferred. The proportion of vegetable derived wax in the composition of this invention is at least 3% by weight and preferably from 5 to 25% by weight of the composition.

Vegetable oils when present in the composition of the invention are preferably liquid at a temperature from 0° C. to 30° C. and can contain triglycerides of saturated and unsaturated fatty acids. The iodine number of such vegetable oils is preferably in the range of 15 to 150. Suitable vegetable oils include corn oil, cottonseed oil, deodorized coconut oil, palm oil, soybean oil, and sunflower oil. When present, vegetable oil can represent 5 to 60% of the composition by weight, preferably 32 to 48% by weight.

Fragrance when present can be such as is perceptible when the candle is exposed to the atmosphere or such as is only perceived when released from the composition by heat as the candle burns. It is a feature of the invention that the low inherent odor level characterizing the selected ingredients of the composition facilitates the provision of candles with agreeable odor characteristics even without scent while permitting the use of any desired fragrance without clashing with an inherent odor of the unscented composition. For the purpose of this invention, fragrance also includes material classified as flavor, which can be natural or synthetic in origin. Suitable natural and synthetic fragrance/flavor substances include those compiled by the US Food and Drug Administration in Title 21 of the Code of Federal Regulations, Sections 172.510 and 172.515 respectively. Particularly suitable fragrances include basil, bergamot, citrus, jasmine, lemongrass, rosemary, and vanilla. When present, the proportion of fragrance in the composition is determined by the strength of the particular fragrance to be used, and is generally in the range from 0.1 to 10% by weight, preferably from 0.5 to 5% by weight.

Oxidation inhibitor when present can be odorless or possess an agreeable odor. Suitable oxidation inhibitors include Vitamin C ascorbic acid and Vitamin E tocopherol as natural prototypes of the category, as well as the vitamin-inactive isomer erythorbic acid, oxy-acids of phosphorus such as phosphoric acid and polyphosphoric acid, aliphatic hydroxypolycarboxylic acids such as citric acid, malic acid, and tartaric acid, EDTA and its sodium and calcium salts, and alkyl-substituted phenols such as BHT, BHA, thymol, carvacrol, 4,4'-butylidenebis(2-t-butyl-5-methylphenol), 1,1,3-tris(2-methyl-4-hydroxy-5-t-butylphenyl)butane and 3,5-di-t-butyl-4-hydroxyphenylpropionic acid and its esters with C1–C18 monohydric alcohols or 2–6 functional polyhydric alcohols. When present, the proportion of oxidation inhibitor is generally in the range from 0.005% to 1% by weight, preferably from 0.01% to 0.5%. The use of oxidation inhibitor in the composition of the invention is particularly preferred in compositions including vegetable oil.

The combustible candle composition can include such additional ingredients as do not adversely affect its favorable odor and burning properties, particularly colorants such as oil soluble dyes and pigments permitting the achievement of desired color effects. Suitable pigments include titanium dioxide and zinc oxide white; copper, bronze, and aluminum metal powders and flakes; and phthalocyanine blue, phthalocyanine green, and yellow and red pigments of the benzimide azolone group such as Pigment Yellow 180 and Pigment Red 208 for colors. For a comprehensive disclosure of pigments and soluble dyes with sufficient thermal stability for use in plastics and therefore also in combustible candle compositions according to this invention, reference can be made to Chapter 63—Organic Colored Pigments (pages 884–899) and Chapter 65—Colors, Dyes (pages 913–919) in "Plastics Additives and Modifiers Handbook", J. Edenbaum (ed.), Van Nostrand Reinhold, New York 1992, herein incorporated by reference.

In the manufacture of candles according to this invention, a wick can be placed in a suitable mold and surrounded by the combustible candle composition of the invention, usually as a melt, to afford a molded candle which can then be removed from the mold after cooling. Alternatively, a hole can be drilled into the shaped candle after melding, cooling, and solidification, and the wick inserted into the hole. Any convenient fiber can be used for the wick with preference given to wicks that burn without generating unpleasant odors. Wicks of cellulose fibers such as cotton are preferred.

Candles according to this invention can be used standing free, as in candlesticks and candelabras, or in suitable containers such as glass, ceramic, or plastic vases. Any container of the finished candle can also serve as the mold in which the combustible composition is brought together with the wick, suitably with a combustible composition including vegetable oil to minimize the temperature required to melt and mold the combustible composition.

The following Examples illustrate the invention without limiting its scope as defined by the appended claims. All parts are by weight.

EXAMPLE 1

The ingredients of a candle composition as shown below were charged to a heated mixing vessel and warmed with stirring until a homogeneous melt was obtained. The melt was then discharged into metal candle molds each containing a cotton wick, allowed to cool and solidify, and removed.

The ingredients of the composition were as follows:

| | |
|---|---|
| Stearic acid | 70 parts |
| Hydrogenated castor oil | 25 parts |
| Fragrance | 4.8 parts |
| Oxidation inhibitor | 0.2 parts |

EXAMPLES 2–8

Candles were made as in Example 1 from compositions having the ingredients shown below:

| EXAMPLE | 2 | 3 | 4 | 5 | 6 | 7 | 8 |
|---|---|---|---|---|---|---|---|
| Stearic acid | 90 | 80 | 90 | 37 | 37 | 37 | 37 |
| Hydrogenated caster oil | 5 | 10 | none | 10 | 10 | 10 | 10 |
| Candelilla wax | none | 5 | 5 | 3 | 3 | 3 | 3 |

-continued

| EXAMPLE | 2 | 3 | 4 | 5 | 6 | 7 | 8 |
|---|---|---|---|---|---|---|---|
| Cottonseed oil | none | none | none | 45 | none | none | none |
| Sunflower oil | none | none | none | none | 45 | none | none |
| Palm oil | none | none | none | none | none | 45 | none |
| Soybean oil | none | none | none | none | none | none | 45 |
| Fragrance | 4.8 | 4.8 | 4.8 | 4.8 | 4.8 | 4.8 | 4.8 |
| Oxidation inhibitor | 0.2 | 0.2 | 0.2 | 0.2 | 0.2 | 0.2 | 0.2 |

What is claimed is:

1. A substantially non-paraffin candle comprising a wick and a combustible candle composition consisting essentially of at least 30 parts by weight of stearic acid, at least 5 parts by weight of vegetable-derived wax having a melting point of at least 50° C., 0–50 parts by weight of at least one vegetable oil liquid at a temperature from 0° C. to 30° C., 0 to 10 parts by weight of at least one fragrance and 0 to 1 part by weight of at least one oxidation inhibitor.

2. A candle according to claim 1 in which the proportion of stearic acid in said combustible candle composition is from 70% to 90% by weight of the composition.

3. A candle according to claim 1 in which the proportion of stearic acid in said combustible candle composition is from 30% to 45% by weight of the composition.

4. A candle according to claim 1 in which the proportion of vegetable-derived wax in said combustible candle composition is from 3% to 25% by weight of the composition.

5. A candle according to claim 1 in which the vegetable-derived wax is selected from the group consisting of arrayan wax, candelilla wax, carnauba wax, and sugar cane wax.

6. A candle according to claim 5 in which the vegetable-derived wax is candelilla wax.

7. A substantially non-paraffin combustible candle composition consisting essentially of at least 30 parts by weight of stearic acid, at least 5 parts by weight of vegetable-derived wax having a melting point of at least 50° C. in which at least 5 parts by weight of said vegetable-derived wax is hydrogenated castor oil, 0–50 parts by weight of at least one vegetable oil liquid at a temperature from 0° C. to 30° C., 0 to 10 parts by weight of at least one fragrance and 0 to 1 part by weight of at least one oxidation inhibitor.

8. A composition according to claim 7 in which the amount of hydrogenated castor oil is 5% to 10% by weight of the composition.

9. A composition according to claim 8 including 3% to 5% of candelilla wax and 10% hydrogenated castor oil.

10. A substantially non-paraffin combustible candle composition consisting essentially of 30% to 45% by weight of stearic acid, 7% to 38% by weight of vegetable-derived wax having a melting point of at least 50° C. and 32% to 48% by weight of at least one vegetable oil selected from the group consisting of corn oil, cottonseed oil, deodorized coconut oil, palm oil, soybean oil, and sunflower oil said percentages summing to 100%, and additionally including 0–50 parts by weight of at least one vegetable oil liquid at a temperature from 0° C. to 30° C., 0 to 10 parts by weight of at least one fragrance and 0 to 1 part by weight of at least one oxidation inhibitor.

11. A candle according to claim 1 including 0.1% to 10% by weight of at least one fragrance selected from the group consisting of natural flavors and fragrances.

12. A candle according to claim 11 including 0/1% –10% by weight of at least one fragrance selected from the group consisting of synthetic flavors and fragrances.

13. A composition according to claim 7 including 0.01% by weight to 0.5% by weight of at least one oxidation inhibitor selected from the group consisting of hindered phenols, oxyacids of phosphorus, hydroxypolycarboxylic acids and salts thereof, and ethylenediaminetetraacetic acid and salts thereof.

14. A candle according to claim 1 in which stearic acid is derived from a vegetable source.

15. A candle comprising a wick and a combustible composition according to claim 7.

16. A candle comprising a wick and a combustible composition according to claim 10.

17. A free standing candle according to claim 1.

18. A candle according to claim 1 in a container.

19. A candle according to claim 15, including 5–10% by weight of hydrogenated castor oil.

20. A candle according to claim 15, including 3–5% by weight of candelilla wax and 10% of hydrogenated castor oil.

21. A candle according to claim 1, in which said combustible candle composition consists essentially of 90 parts by weight of stearic acid, 5 parts by weight of candelilla wax, 4.8 parts by weight of fragrance, and 0.2 parts by weight of oxidation inhibitor.

22. A combustible candle composition according to claim 7 consisting essentially of 70 parts by weight of stearic acid, 25 parts by weight of hydrogenated castor oil, 4.8 parts by weight of fragrance, and 0.2 parts by weight of oxidation inhibitor.

23. A combustible candle composition according to claim 7 consisting essentially of 90 parts by weight of stearic acid, 5 parts by weight of hydrogenated castor oil, 4.8 parts by weight of fragrance, and 0.2 parts by weight of oxidation inhibitor.

24. A combustible candle composition according to claim 7 consisting essentially of 80 parts by weight of stearic acid, 10 parts by weight of hydrogenated castor oil, 5 parts by weight of candelilla wax, 4.8 parts by weight of fragrance, and 0.2 parts by weight of oxidation inhibitor.

25. A combustible candle composition according to claim 7 consisting essentially of 37 parts by weight of stearic acid, 10 parts by weight of hydrogenated castor oil, 3 parts by weight of candelilla wax, 45 parts by weight of a vegetable oil selected from the group consisting of cottonseed oil, sunflower oil, palm oil, and soybean oil, 4.8 parts by weight of fragrance, and 0.2 parts by weight of oxidation inhibitor.

26. A candle comprising a wick and a combustible candle composition according to claim 22.

27. A candle comprising a wick and a combustible candle composition according to claim 23.

28. A candle comprising a wick and a combustible candle composition according to claim 24.

29. A candle comprising a wick and a combustible candle composition according to claim 25.

* * * * *